United States Patent [19]

Alieri

[11] Patent Number: 4,462,781

[45] Date of Patent: Jul. 31, 1984

[54] APPARATUS FOR FEEDING AND POSITIONING CLAY BLANKS AND MOLDING BRICKS THEREFROM

[76] Inventor: Rodiero Alieri, Via Liverani, 7, Imola, Bologna, Italy

[21] Appl. No.: 395,873

[22] Filed: Jul. 7, 1982

Related U.S. Application Data

[63] Continuation of Ser. No. 055,678, Jul. 9, 1979, abandoned.

[30] Foreign Application Priority Data

Jul. 10, 1978 [IT] Italy ..... 3491 A/78

[51] Int. Cl.[3] ..... B28B 17/00

[52] U.S. Cl. ..... 425/145

[58] Field of Search ..... 425/145

[56] References Cited

U.S. PATENT DOCUMENTS

| | | | |
|---|---|---|---|
| 1,550,014 | 8/1925 | Debay | 425/219 |
| 2,061,497 | 11/1936 | Beauchamp | 425/218 |
| 4,105,383 | 8/1978 | Hanson | 425/145 |

*Primary Examiner*—James R. Hall

*Attorney, Agent, or Firm*—Guido Modiano; Albert Josif

[57] ABSTRACT

The apparatus comprises a conveyor for delivering clay blanks to the press, vertically movable lifter plates, for raising the blanks to a level above the conveyor, pusher members which transfer the blanks from the lifter plates to a platform which delivers the blanks to gripping means, which grip the clay blanks and transfer them into the mold cavities. Positioning means correct the distance between the blanks on the platform to make it coincident with that between the cavities of the mold.

5 Claims, 8 Drawing Figures

APPARATUS FOR FEEDING AND POSITIONING CLAY BLANKS AND MOLDING BRICKS THEREFROM

This is a continuation of application Ser. No. 06/055,678 filed July 9, 1979 now abandoned.

BACKGROUND OF THE INVENTION

This invention relates to an apparatus for feeding clay blanks to, and positioning them into, the mold of a brick molding press.

A method of molding bricks has been proposed which consists of subjecting blocks of clay blank to plastic deformation in a press mold. The blocks are preformed according to a shape coarsely similar to that of the finished bricks usually such blocks are obtained by cutting them off from a string of clay supplied by an extruding machine. In the following such performed blocks of clay are defined as clay blanks.

SUMMARY OF THE INVENTION

This invention sets out to provide an apparatus for feeding and positioning clay blanks into the mold of a press for brick molding.

According to the present invention, there is provided an apparatus comprising a transporting conveyor for delivering clay blanks to a press, lifter plates arranged at the press and adapted for raising a predetermined number of clay blanks arriving on the conveyor to a level overlying the same, means for positioning the blanks located between said lifter plates and the press mold and operatively cooperating with a vertically movable platform, pusher means for transferring said blanks from the lifter plates onto said platform, said positioning means being operative to position said blanks onto said platform such as to bring them into alignment with cavities of said mold, blank gripping means movable between a position overlying said platform, in which they pick up said blanks after they have been positioned, and a position overlying the mold cavities, in which they drop said blanks into said cavities.

BRIEF DESCRIPTION OF THE DRAWINGS

Further advantages and features of this invention will be more clearly apparent from the following detailed description of an exemplificative and not limitative embodiment thereof, illustrated by way of example in the accompanying drawings, where.

DESCRIPTION OF THE PREFERRED EMBODIMENTS

Figures 1, 2:
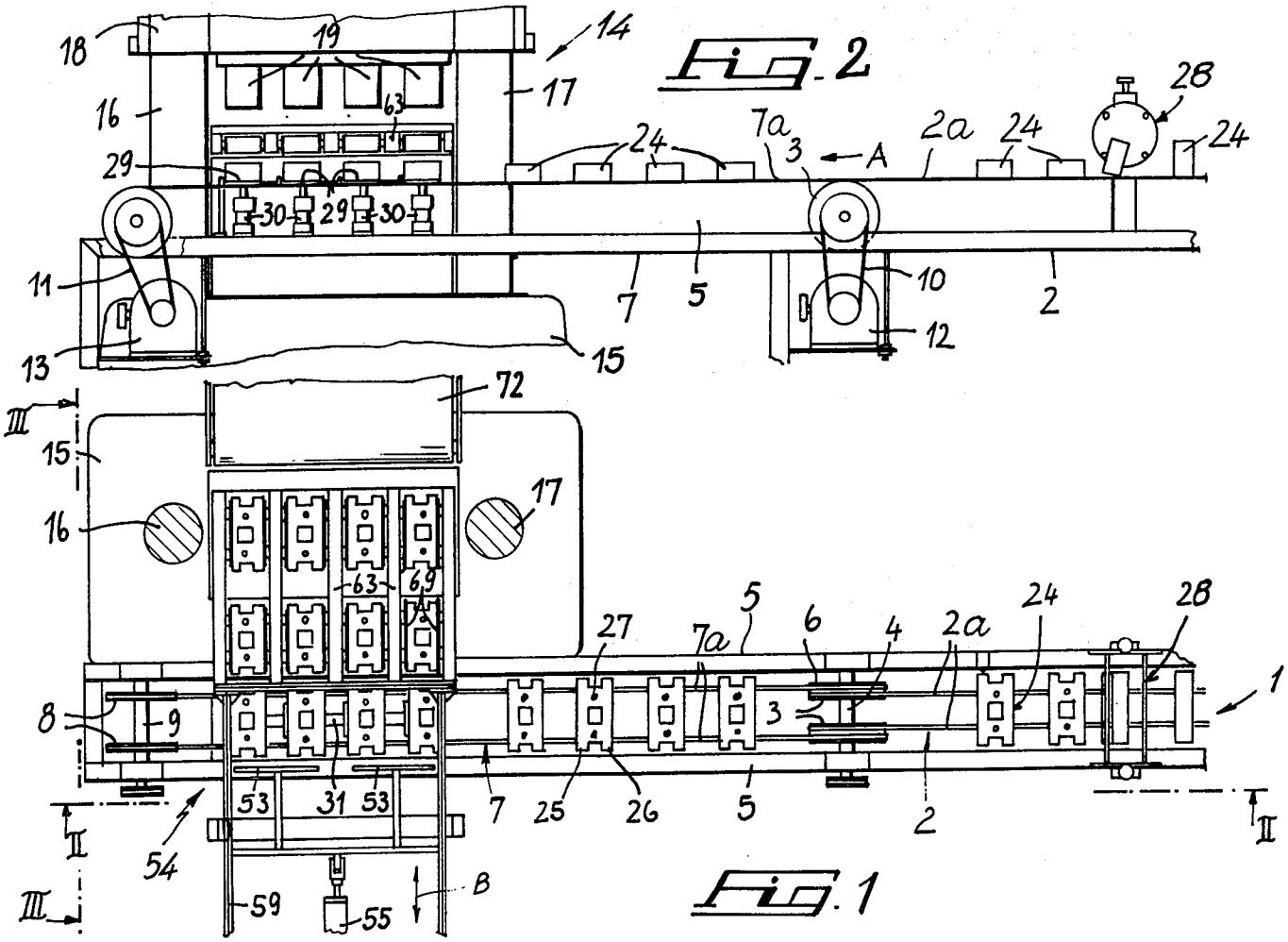
FIG. 1 is a plan view, partly schematical, of this apparatus.
FIG. 2 is an elevational view taken along the line II—II of FIG. 1.

With reference to the drawing figures, the apparatus comprises a transporting conveyor 1 including a first pair of belts 2, wound around pulley pairs, whereof only the downstream ones are shown in the drawings, as indicated at 3. The upper strands of belt 2 are indicated with reference numeral 2*a*. The pulleys 3 are keyed to a shaft 4 which is rotatably carried in a frame 5. To that same shaft 4, there is keyed a second pair of pulleys 6, adjacent the former, around which is wound a second pair of horizontal belts 7, in alignment with the belts 2 and forming a closed loop around further pulleys 8. The latter are rotatively rigid with a shaft 9 rotatively carried in that same frame 5. The upper strand of belts 7 are indicated with reference numerals 7*a*.

The shafts 4 and 9 are driven, through drive belts 10, 11, by motor drives 12, 13 such that the upper strands 2*a* and 7*a* of the belts 2, 7 move in the direction of the arrow A (FIG. 2). The conveyor 1 is connected upstream to an extruder delivering a clay string wherefrom, by means of suitable cutting members, sets of blanks are cut which are intended for feeding the molding press which, in the drawing, is generally indicated at 14 and is arranged laterally with respect to the terminating portion of the conveyor 1.

Figure 3:
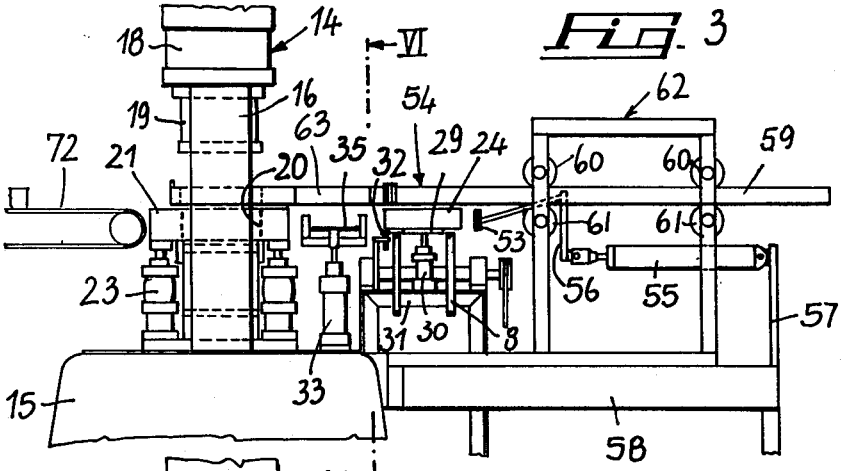
FIGS. 3–5 show three views taken along the line III—III of FIG. 1 of as many operative situations of the apparatus.
Figure 4:
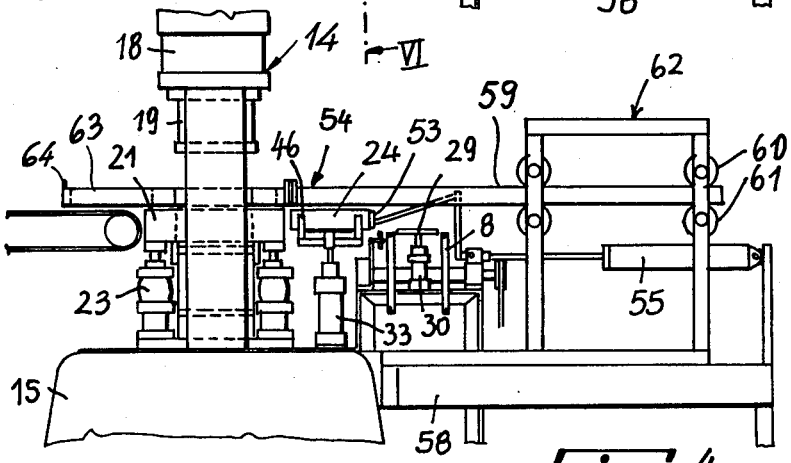
Figure 5:
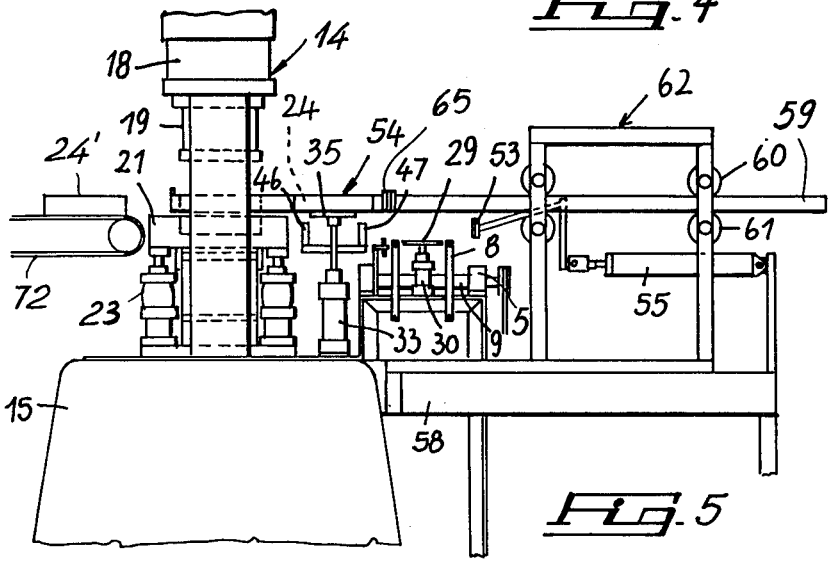
Figure 7:
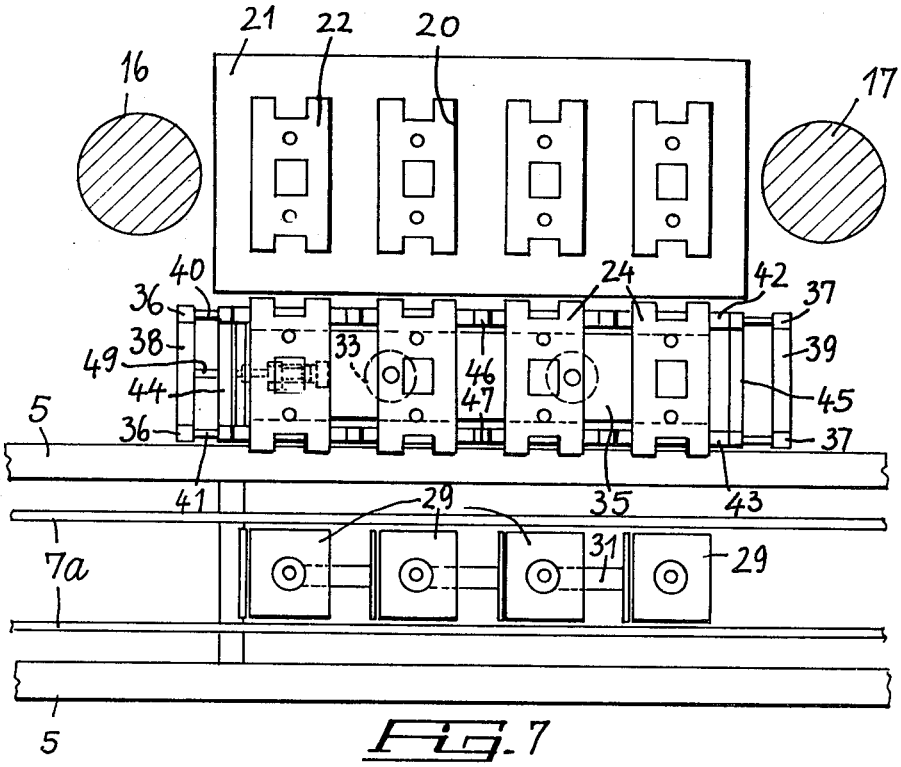
FIG. 7 shows a view taken along the line VII—VII of FIG. 6.

The press 14 comprises, in a known manner, a base 15 from which two columns 16, 17 extend, interconnected at the top by a fixed crosspiece, not shown in the drawings. On the columns, a movable crosspiece 18 is slidably guided which carries at the bottom punches 19 which, by penetrating the cavities 20 of a die 21, which are closed at the bottom by counterpunches 22 (FIG. 7) cause the molding of the bricks from the blanks previously formed and introduced thereinto. The die 21 is supported at the base 15 by shock absorbers 23 which permit a certain vertical yield (FIGS. 3–5). The die 21 together with the punches 19 and counterpunches 22, forms the press mold.

The press in the example shown is capable of producing four bricks at a time. Consequently, the extruder delivers sets of four blanks 24 having a double "H" shape comprising two longitudinal webs 25, 26 interconnected by bridges 27, and provided with through holes (FIG. 1). The blanks 24 are initially arranged edgewise on the strands 2*a* of belts 2 at a mutual distance which, owing to intervening manipulations, is not constant. A tilting device 28 tilts the blanks 24 flat.

The apparatus according to this invention is operative to equally space apart the blanks 24 of each set by a distance equal to the distance separating the cavities 20 of the die 21 and to transfer them into the latter.

For this purpose, at the terminating portion of the conveyor 1 there are arranged four lifter plates 29 which are movable vertically by means of respective pressure fluid operated cylinders 30 from a position below the level of the upper strands 7*a* of the belts 7. to a position above said level. The cylinders 30 are supported by a crosspiece 31 rigid with the frame 5 and are operatively associated with respective photocells 32 detecting the arriving blanks so as to cause the lifter plates 29 to rise in succession. The blanks 24 are thus raised from the upper strands 7*a* of the belts 7 and held at such a raised position at a mutual distance apart which does not correspond as yet to that between the cavities 20.

On the sides of the plates 29, between the latter and the press 14, there are arranged positioning means which are operative to correct or adjust the distance between the blanks 24 such as to make it coincident with that between the cavities 20.

Figure 6:
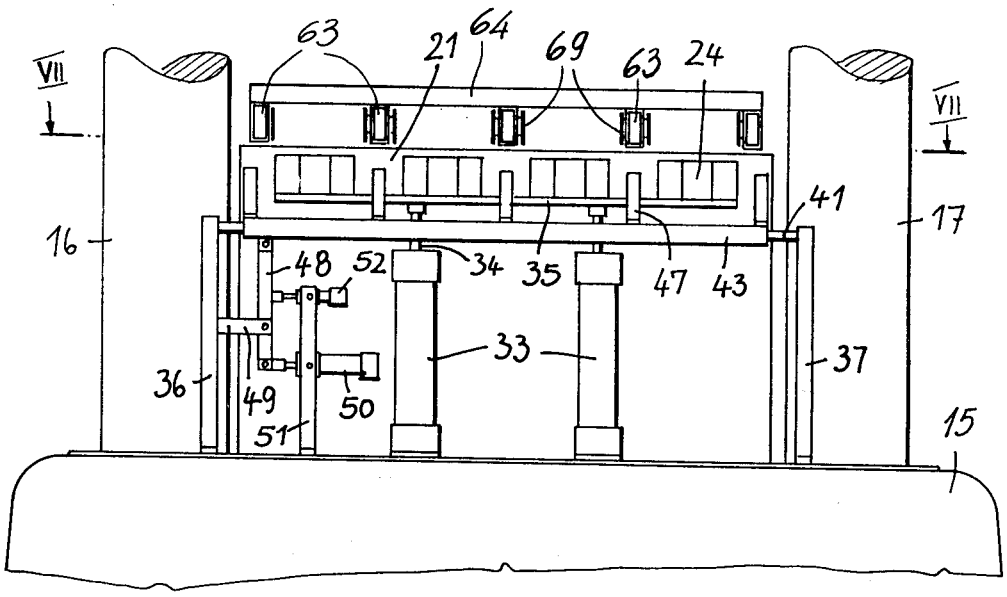
FIG. 6 is a view in an enlarged scale taken along the line VI—VI of FIG. 3.

Such positioning means (see FIGS. 6,7) comprise a pair of vertical pressure fluid operated cylinders 33 resting on the base 15 of the press 14 and provided with rods 34 connected with a horizontal platform 35 offset from the lifter plates 29, as visible in FIGS. 3 to 5. The operation of the cylinders 33 is such as to bring the platform 35 from a level coplanar with the lifter plates 29, as the latter are at their raised position, to a level slightly above the plane of the die 21.

On the sides of the cylinders 33 there extend, from the base 15, pairs of uprights 36, 37 (FIGS. 6, 7) the tops whereof are interconnected by cross stringers 38, 39. The uprights 36 are connected to the uprights 37 by two horizontal parallel rods 40, 41 which extend on the sides of the platform 35 and on which respective sleeves 42, 43 are guided. The sleeves 42, 43 are interconnected at their opposite ends by bridges 44, 45. Teeth 46, 47 extend upwardly from the sleeves and have a mutual distance strictly equal to that of the cavities 20. Each tooth 46 is aligned, in a perpendicular direction to the rods 40, 41, with a respective tooth 47 such as to form pairs of teeth between which the blanks 24, which are being transferred from the lifter plates 29 onto the platform 35, are located as will be apparent hereinafter. The rods 40, 41, the sleeves 42, 43, the teeth 46, 47, and the hereinafter described lever system 48, 49 and fluid pressure operated cylinders 50, 52 constitute positioning means for adjusting the position of the blanks on the platform 35.

When the blanks 24 are put on the platform 35 adjusting of the position the blanks 24 onto the platform 35 is effected by first moving sideways the blanks until the latter abut a first stop member (not shown), and then towards the opposite side up to a second stop member (not shown) whereat the blanks 24 are perfectly aligned with the respective cavities 20. The displacement of the blanks 24 is effected by means of a linkage comprising a rocker lever 48 (FIG. 6) which is journalled, at a middle position, to a bracket 49 rigid with the uprights 36. The top end of the rocker lever 48 is articulated under the bridge 44 and its bottom end is hingedly connected to the rod of a pressure fluid operated cylinder 50 which is pivotally carried by a column 51 mounted on the base 15. A similar cylinder 52, pivotally carried on the same column 51 above the cylinder 50, acts on the rocker lever 48 at an intermediate position between the articulation points of the rocker lever 48 in the bridge 44 and the bracket 49.

Transfer of the blanks from the lifter plates 29 to the platform 35 is effected by means of a double pusher 53 (see FIGS. 1, 3–5) projecting downwardly from a frame generally indicated at 54 and reciprocated back and forth in the direction B (FIG. 1) with the aid of a cylinder 55. The rod of this cylinder is in fact linked to a lower projection 56 of the frame 54, while the cylinder is articulated to a bracket 57 projecting from a base 58.

The frame 54 comprises a pair of longitudinal stringers 59 which are guided horizontally between pairs of upper rollers 60 and lower rollers 61, cantilever-like mounted on a frame 62 installed on the base 58.

Figure 8:
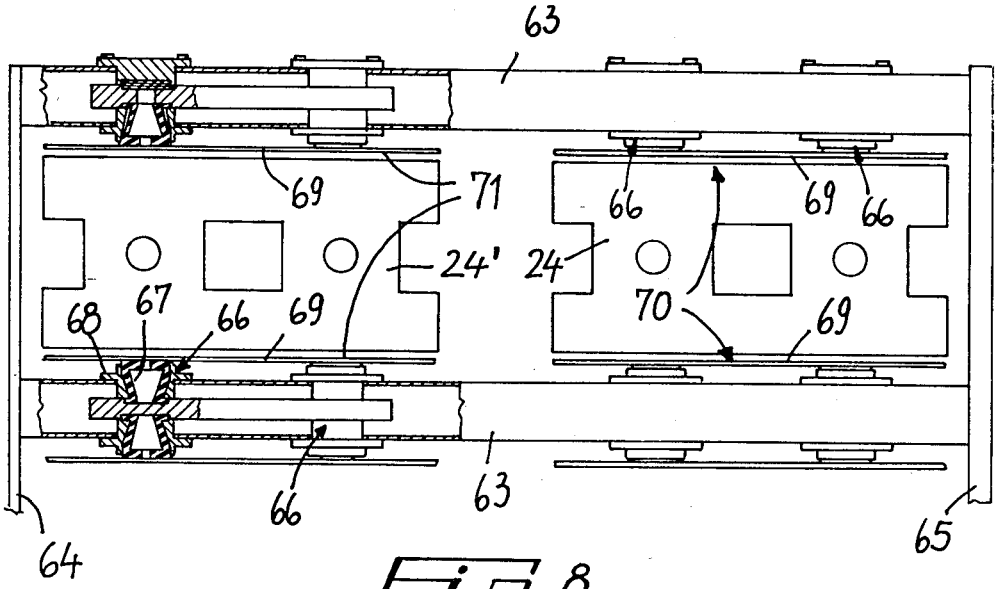
FIG. 8 is a top view of the gripping means shown in a position rotated by 90° in anti-clockwise direction with respect to the position shown in FIG. 6.

Carried by the longitudinal stringers 59, are gripper means which are operative to pick up the blanks positioned on the platform 35 and to transfer them into the cavities 20 of the die. Such gripper means, as shown best in FIG. 8, comprise plurality of spaced apart tubular elements 63, parallel to one another and interconnected by crossmembers 64, 65 thereby to form a grid-like structure. The crossmembers 64, 65 are secured to the longitudinal stringers 59. Inside the tubular elements 63, there are arranged pairs of pneumatically expanding members 66 each comprising two cup-like elements 67 of a rubber material located inside bushings 68 which are affixed in the tubular elements 63.

To the cup-like elements 67 of each pair, there is rigidly attached a respective clamping wall 69 which constitutes one of the two jaws of clamping means for gripping the blanks 24.

In practice, between two adjacent tubular elements 63, there are provided two clamping means comprising each a pair of said opposing and mutually spaced apart clamping side walls 69, arranged at a distance apart to leave a free space which in unexpanded condition of the cup-like rubber elements 67 is slightly larger than the width of a blank or of a molded brick.

For greater clarity of description, the clamping means comprising the two opposing clamping side walls 69 adjacent to the crossmember 65 and destined for the blanks 24 are indicated hereinafter as first clamping means 70, those adjacent to the crossmember 64 and destined for the molded bricks 24' (FIG. 8) being indicated as second clamping means 71.

The apparatus described hereinabove operates as follows.

The blanks 24, as tilted by the tilting device 28 (FIG. 1) are fed in sets of four each, onto the conveyor 1, which transports them on to the lifter plates 29. As the foremost of the blanks 24 in each set reaches the farthest plate 29, the photocell 32 associated to this plate becomes operative to actuate its related cylinder 30, thereby the blank is raised from the upper strands 7a of the belts 7 and at the same time the preceding plate is preset for raising upon the arrival of a further blank. Thus, the preceding plate is raised and than the other plates are raised sequentially.

As all of the lifter plates 29 are raised, (FIG. 3) the cylinder 55 is actuated which, by means of the pusher 53, becomes operative to transfer the blanks 24 onto the platform 35, which at the moment is in a position coplanar with the raised lifter plate 29 as visible in FIG. 4. At this moment, the adjusting of the position of the blanks occurs on the platform 35. To this aim, the cylinder 50 is first actuated which, through the rocker lever 48 and the pairs of teeth 46, 47, causes a simultaneous displacement of all the blanks rightwards in FIG. 6, up to a preestablished limit. Then the cylinder 52 is actuated which causes the teeth 46, 47 to move in the opposite direction up to another preestablished limit, whereat the blanks 24 are perfectly in vertical alignment with the free spaces between the clamping side walls 69 of the overlying gripping means 70. Then, the cylinders 33 are actuated raising the platform 35 with the blanks 24 to insert them into the free-spaces between the side walls 69 (FIG. 5) which, by sending compressed air into the cup-like elements 67, are caused to move toward each other and grip the blanks. The subsequent actuation of the cylinder 55 causes the blanks thus gripped to be transferred towards the die 21 of the mold and positioned in vertical alignment with the cavities 20 ready to be released therefrom into the die cavities 20.

It should be pointed out that, while the first clamping means 70 are at a position overlying the platform 35 (FIG. 3), the second clamping means 71 are vertically aligned with the cavities 20 and ready to receive the bricks 24' which, after the molding thereof, are ejected upwardly out of the cavities 20 by means of an ejecting member (not shown) which normally equips such presses. Thus, as the blanks 24 are being transferred from the position overlying the platform 35 on the die 21, there occurs simultaneously the transfer of the molded bricks 24' from the die onto a removing conveyor 72 (FIG. 5).

Furthermore, it should be noted that the tubular elements 63 do not interfere with the lowering movement of the punches 19, because they are dimensioned such as to penetrate the interspaces between the punches themselves.

I claim:

1. An apparatus for feeding and positioning clay blanks into mold cavities of a press for molding bricks from said clay blanks comprising a transporting conveyor for the clay blanks having a conveyor portion laterally arranged in front of said mold cavities at a distance therefrom, lifter plates arranged along said conveyor portion and adapted for raising a predetermined number of clay blanks from a laying position thereof on said conveyor portion to a position thereof above said conveyor portion, a platform arranged between said conveyor portion and said mold cavities and vertically movable between a position of substantial coplanarity with said lifter plates when the latter have raised the clay blanks from the conveyor and a raised position, pusher means for transfering the clay blanks from said lifter plates onto said platform when the lifter plates and the platform are in said coplanarity position, positioning means for adjusting the position of the clay blanks on said platform for alignment with the mold cavities, gripping means movable between a position overlaying said platform in which they grip said clay blanks after said adjusting positioning thereof and a position overlaying said mold cavities in which the gripped clay blanks are dropped into said mold cavities and punch means for molding bricks from said clay blanks in said mold cavities.

2. An apparatus according to claim 1, further comprising pressure fluid cylinders for imparting vertical movement to said lifter plates and photocells operatively associated with said cylinders for detecting a clay blank when braught above a respective lifter plate to thereupon actuate the respective cylinder for raising said lifter plates in succession.

3. The apparatus of claim 1 wherein said positioning means comprise a pair of horizontal and parallel rods between which the platform is arranged, sleeves guided on said rods and provided with respective spaced apart teeth extending upwardly on both sides of the platform, the distance between consecutive teeth being equal to the distance between mold cavities, each tooth of one sleeve being aligned, in a direction perpendicular to said rods, with a respective tooth of the other sleeve, thereby forming pairs of teeth between which the clay blanks transferred onto the platform are arranged, said sleeves being driven in opposite directions for adjusting the position of said clay blanks on said platform for alignment with the respective mold cavities.

4. The apparatus of claim 1 further comprising a frame movable horizontally and wherein said pusher means are mounted on said frame and wherein said gripping means comprise a plurality of tubular elements carried on said frame and arranged parallel to one another and interconnected by crossmembers, first clamping means including pairs of expanding members mounted on said tubular elements and supporting clamping side walls between which clay blanks are inserted in the raised position of said platform, actuation of said expanding members causing approaching of clamping side walls and gripping of the clay blanks inserted therebetween.

5. The apparatus of claim 4 wherein said frame further comprises gripping means adapted to grip the molded bricks ejected from the mold cavities and to transfer said bricks onto a removing conveyor while said clay blanks are transferred into said mold cavities.

* * * * *